US005161314A

United States Patent [19]

Souza

[11] Patent Number: 5,161,314

[45] Date of Patent: Nov. 10, 1992

[54] APPARATUS AND METHOD FOR CONTROLLING A DRYING COOL-DOWN CYCLE OF A CLOTHES DRYER

[75] Inventor: William J. Souza, Falls River, Mass.

[73] Assignee: American Dryer Corporation, Fall River, Mass.

[21] Appl. No.: 716,279

[22] Filed: Jun. 17, 1991

[51] Int. Cl.[5] ..... F26B 3/00

[52] U.S. Cl. ..... 34/30; 34/48; 34/53; 34/55; 34/133 L; 34/44

[58] Field of Search ..... 34/44, 48, 55, 53, 30, 34/130, 132, 133 J, 133 L, 26, 29, 31

[56] References Cited

U.S. PATENT DOCUMENTS

| | | | |
|---|---|---|---|
| 3,169,838 | 2/1965 | Kripke | 34/45 |
| 3,293,769 | 12/1966 | Graham | 34/45 |
| 3,381,389 | 5/1968 | Kurowski | 34/45 |
| 3,599,342 | 8/1971 | Cotton | 34/45 |
| 3,610,001 | 10/1971 | Pellerin | 68/12 R |
| 3,628,101 | 12/1971 | Dietz | 317/141 R |
| 3,647,196 | 3/1972 | Cotton | 263/33 B |
| 4,206,552 | 6/1980 | Pomerantz et al. | 34/48 |
| 4,477,982 | 10/1984 | Cotton | 34/48 |
| 4,483,082 | 11/1984 | Ellingson | 34/48 |
| 4,622,759 | 11/1986 | Abe et al. | 34/48 |
| 4,713,894 | 12/1987 | Roth et al. | 34/55 |
| 4,763,425 | 8/1988 | Grennan | 34/48 |
| 4,827,627 | 5/1989 | Cardoso | 34/48 |
| 4,945,652 | 8/1990 | Clarke et al. | 34/12 |

*Primary Examiner*—Henry A. Bennet
*Assistant Examiner*—Denise L. F. Gromada
*Attorney, Agent, or Firm*—Pollock, Vande Sande & Priddy

[57] ABSTRACT

A dryer of the type having a burner for supplying a source of hot gas for drying material being tumbled. The apparatus provides a cool-down cycle for the dryer. A burner control circuit enables and disables the burner to supply hot gasses in accordance with a sequence which produces a substantially linearly decreasing temperature over time. At the end of the time interval a signal is generated indicating that the cool-down sequence has been completed. Each cool-down cycle starts from the same initial temperature as determined by the operator such that the final cool-down temperature for the same cool-down run time is the same.

16 Claims, 8 Drawing Sheets

APPARATUS AND METHOD FOR CONTROLLING A DRYING COOL-DOWN CYCLE OF A CLOTHES DRYER

BACKGROUND OF THE INVENTION

The present invention relates to the process of drying materials in a tumble chamber using hot air, but more particularly it relates to the importance of controlling the cool-down cycle at the end of the drying cycle to avoid excessive wrinkling of the materials being dried.

Conventional dryers, such as those as described in U.S. Pat. No. 4,827,627, comprise a tumble chamber in which materials to be dried are placed. The materials are rotated to effect tumbling of the materials while a burner controlled by a microprocessor controller provides a stream of hot air to the chamber. The drying temperature is maintained relatively constant throughout the drying cycle by the ability of the microprocessor controller to enable and disable the burner. Once the drying cycle time has expired, conventional dryers disable the burner and enter a free tumbling cool-down cycle. During this cool-down cycle cool air is passed through the tumble chamber for a preselected period of time, such time usually being preselected by the operator. In any event, the conventional drying system results in an uncontrolled cool-down cycle whereby the temperature gradient can vary sharply depending upon the amount and type of material being dried and the nature of the drying cycle prior to entering the cool-down cycle. An uncontrolled cool-down cycle can cool a given material much more rapidly than would be desirable to comply with the manufacturer's recommendation to obtain a substantially wrinkle free final product. For certain materials many of the steps of preparation, primarily pressing, can be eliminated if proper care is taken during the drying and cool-down cycles.

Since it is an object of any drying process to diminish the steps in preparing materials for use, a controlled cool-down cycle as disclosed in the present invention can eliminate much of the wrinkling problems associated with conventional dryers. This benefits the operator or owner by minimizing time and money spent in the preparation of materials, by avoiding the labor-intensive steps, or at least minimizing the extent of such steps of pressing or steaming materials, prior to their use. The expense associated with industrial pressing equipment can also be reduced since fewer of the materials being dried will require pressing.

In order to further improve the quality of the cool-down cycle, a pre-cool-down cycle is desirable. This cycle insures that the starting temperature of the cool-down cycle is at a preselected minimum. The microprocessor has the ability to cycle a sequence of burner on and off periods following the drying cycle to reach a predetermined temperature prior to entering the cool-down cycle. This insures the ability to control cool-down as precisely as possible by consistently starting with a designated minimum temperature. It further insures that the material contained in the tumble chamber completes the drying cycles as wrinkle-free as possible.

Preferably, the microprocessor controller contains a number of drying cycle and cool-down cycle selections, available to the operator to accommodate different materials which may be dried. Such cycles would require both time and temperature settings. The operator would choose from a number of selections, but preferably would select a drying cycle at a constant temperature in the range of 200 degrees Fahrenheit for a fixed duration of time, and a cool-down cycle having another fixed duration of time. The microprocessor controller would be preprogrammed such that the minimum cool-down cycle would have a time duration which insures that the materials reach a safe handling temperature before the operator removes them from the tumble chamber.

The problem of cool-down has been addressed in the prior art. U.S. Pat. No. 4,763,425 uses a combination of sensors, automatic controls and operator inputs to determine an upper level drying temperature, a drying time and the subsequent cool-down period. It is recognized that different cool-down durations are preferred for different materials which can avoid excessive wrinkling and damage to the specific materials being dried. U.S. Pat. No. 3,381,389 also allows for the variations of the cool-down periods by providing the operator with a manually operated switch to adjust the cool-down period. The present invention seeks to further improve the cool-down cycle by controlling the cool-down temperature gradient of the cool-down cycle.

SUMMARY OF THE INVENTION

It is an object of this invention to establish a controlled cool-down cycle for improving the drying process of a dryer of the type having a burner and a chamber for constant tumbling of a material being dried.

It is a specific object of this invention to provide a material drying apparatus and process which produces a minimum amount of wrinkles in the material being dried by control of the temperature, time, and the cool-down cycle temperature gradient.

It is a secondary object of this invention to provide a pre-cool-down cycle which brings the material being dried to a predetermined minimum temperature prior to entering the cool-down cycle.

In accordance with the invention a controlled cool-down cycle is provided in a dryer of the type having a burner for supplying hot air to a constantly rotating tumbler. The drying time for the materials is divided into at least two portions. The first portion of the drying time is a drying cycle which uses a burner in combination with a microprocessor controller to control the drying temperature of the material in the tumble chamber at a relatively constant temperature over a preselected time. The drying cycle is followed by a cool-down cycle which utilizes the same burner and microprocessor controller to obtain a decreasing temperature profile of the material in the tumble chamber over a second preselected time. The microprocessor driven controller, which can be connected to a temperature sensor for monitoring drying temperatures, supplies burner on and off times to be used during the cool-down cycle to obtain the desired temperature versus time profile. In the preferred embodiment, the microprocessor controller sequences the burner on and off over time maintaining the relatively constant temperature of the drying cycle and the linearly decreasing temperature of the cool-down cycle.

In the preferred embodiment, prior to entering the cool-down cycle, a temperature sensor connected to the microprocessor controller measures the drying temperature in the tumble chamber. Depending on the temperature sensor reading, the microprocessor may cycle the burner on and off to bring the material temperature in the tumble chamber to a predetermined minimum temperature. Once the predetermined minimum temperature is obtained the microprocessor controller enters the cool-down cycle. Should the predetermined minimum temperature already exist at the end of the drying cycle the microprocessor is programmed to enter directly into the cool-down cycle thereby avoiding the pre-cool-down step.

DESCRIPTION OF THE PREFERRED EMBODIMENT

Figure 1:
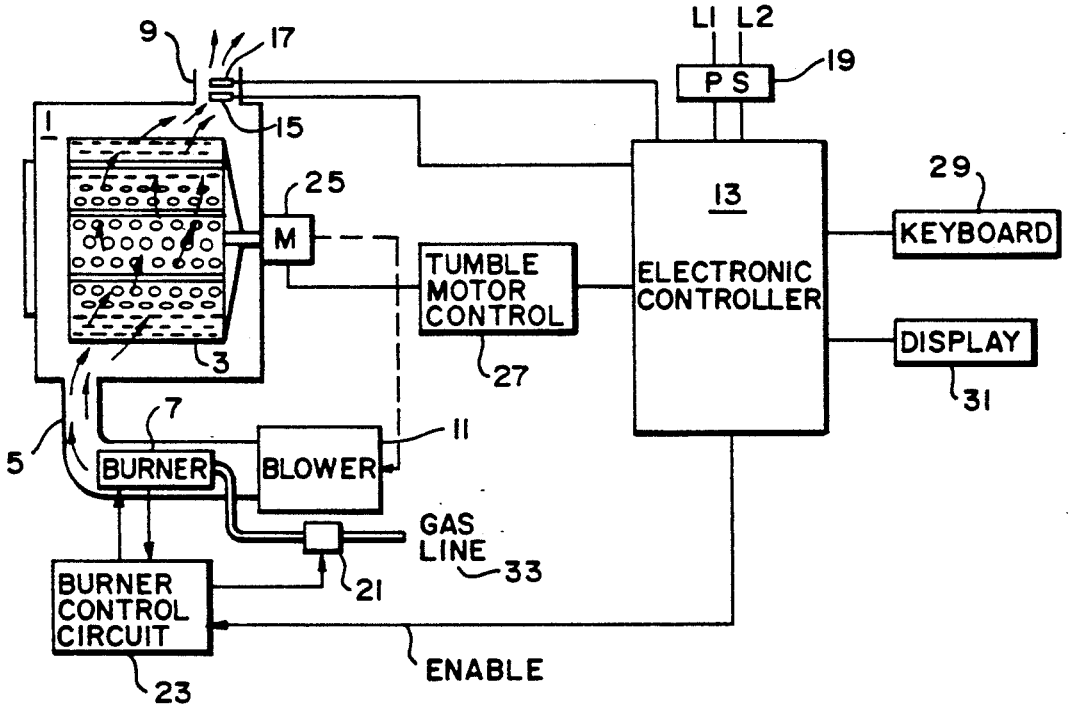
FIG. 1 is an overall block diagram illustrating a configuration of a drying system which incorporates a preferred embodiment of the invention.

Referring to FIG. 1, there is shown an embodiment of an apparatus which will employ the controlled cool-down cycle of the present invention. The device includes a drying chamber 1 housing a material tumbler 3. A stream of gases is supplied by a blower 11, the gases being heated as they pass over a burner 7 and subsequently enter the drying chamber 1 through the gas distributor 5. The microprocessor controller 13 maintains the hot gas temperature by enabling and disabling the burner 7 indirectly by way of the burner control circuit 23. The hot gases exit the tumble chamber through exhaust port 9 where they contact temperature sensor 15 and safety toggle interlock 17.

An electronic microprocessor controller 13 which may be of the type shown in FIG. 3A of U.S. Pat. No. 4,827,627, is connected to a power supply 19 which supplies the operating voltage to the electronic microprocessor controller 13. The microprocessor controller 13 maintains constant control over the drying temperature of drying chamber 1 through temperature sensor 15. In addition, the drying system is protected by a safety toggle interlock 17 connected to the controller 13. Should the safety toggle interlock 17 detect a maximum temperature in the exhaust port 9 that could, for example, be the result of spontaneous combustion in the tumble chamber 3, the safety toggle interlock 17 will immediately interrupt the enable signal to the burner and stop the drying process. Preferably, an indication of this condition would be presented on the display 31 and through an audible alarm.

The burner control circuit 23 is further connected to a solenoid 21 inserted in the gas line 33. The burner control circuit 23 serves as a relay between the microprocessor controller 13 and the solenoid 21. This permits the microprocessor controller to enable and disable the burner 7 thereby maintaining the correct constant temperature during the drying cycle.

The microprocessor controller 13 is connected to the material tumbler motor 25 through a tumble motor control 27. The microprocessor controller 13 has the ability to start and stop the material tumbler 3 and to enable and disable the burner 7 to maintain desired temperatures.

Interface between the operator and the microprocessor controller 13 is provided by a keyboard 29 and a display screen 31. The keyboard 29 serves as a means for the operator to preprogram select drying schedules into the microprocessor controller 13 regarding drying cycle times typically from zero to ninety-nine minutes and temperatures, pre-cool-down temperatures and cool-down times. The microprocessor controller 13 can indicate the status of the drying operations to the operator on the display 31, such as remaining time, temperature, etc.

Figure 2:
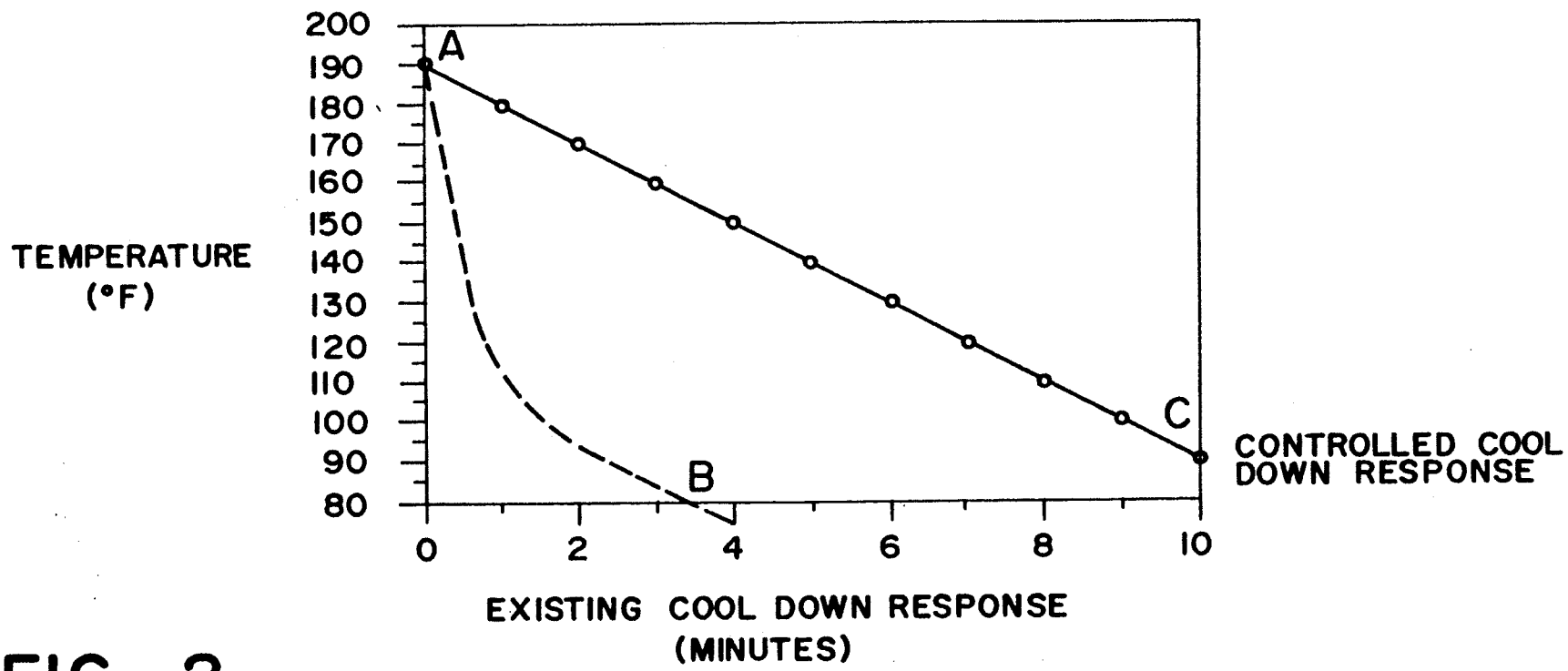
FIG. 2 is a line graph showing the cool-down temperature gradient of prior art superimposed on a cool-down temperature gradient of a preferred embodiment of the present invention.

Referring now to FIG. 2, a comparison is shown, generally, between the prior art cool-down cycles where the burner 7 is disabled, and the preferred embodiment of the present invention where the burner 7 is cycled during the course of the cool-down cycle. Curve AB represents the prior art cool-down cycle where the burner 7 is disabled and a stream of cool air passes through the drying chamber 1 for a designated period of time. The curve shows that when the prior art cool-down cycle begins at an initial temperature of 190° F., there will be a rapid decrease in temperature during the first two to three minutes, followed by more gradual decreasing temperature over time, until the cool-down cycle is terminated.

Line AC, on the other hand, is representative of a cool-down cycle attainable by the preferred embodiment of the present invention. The present invention begins with a preselected minimum temperature, preferably in the temperature range of 190 to 200 degrees Fahrenheit. The cool-down cycle, being controlled by the microprocessor controller 13, comprises a sequence of enabling and disabling the burner 7 during the entire cool-down cycle. Hence, the drying chamber 1 temperature linearly decreases over time until the termination of the cool-down cycle. The final cool-down temperature will be dependent on the initial cool-down starting temperature and the time selected by the operator for cool-down prior to initiating the drying process.

Figure 3:
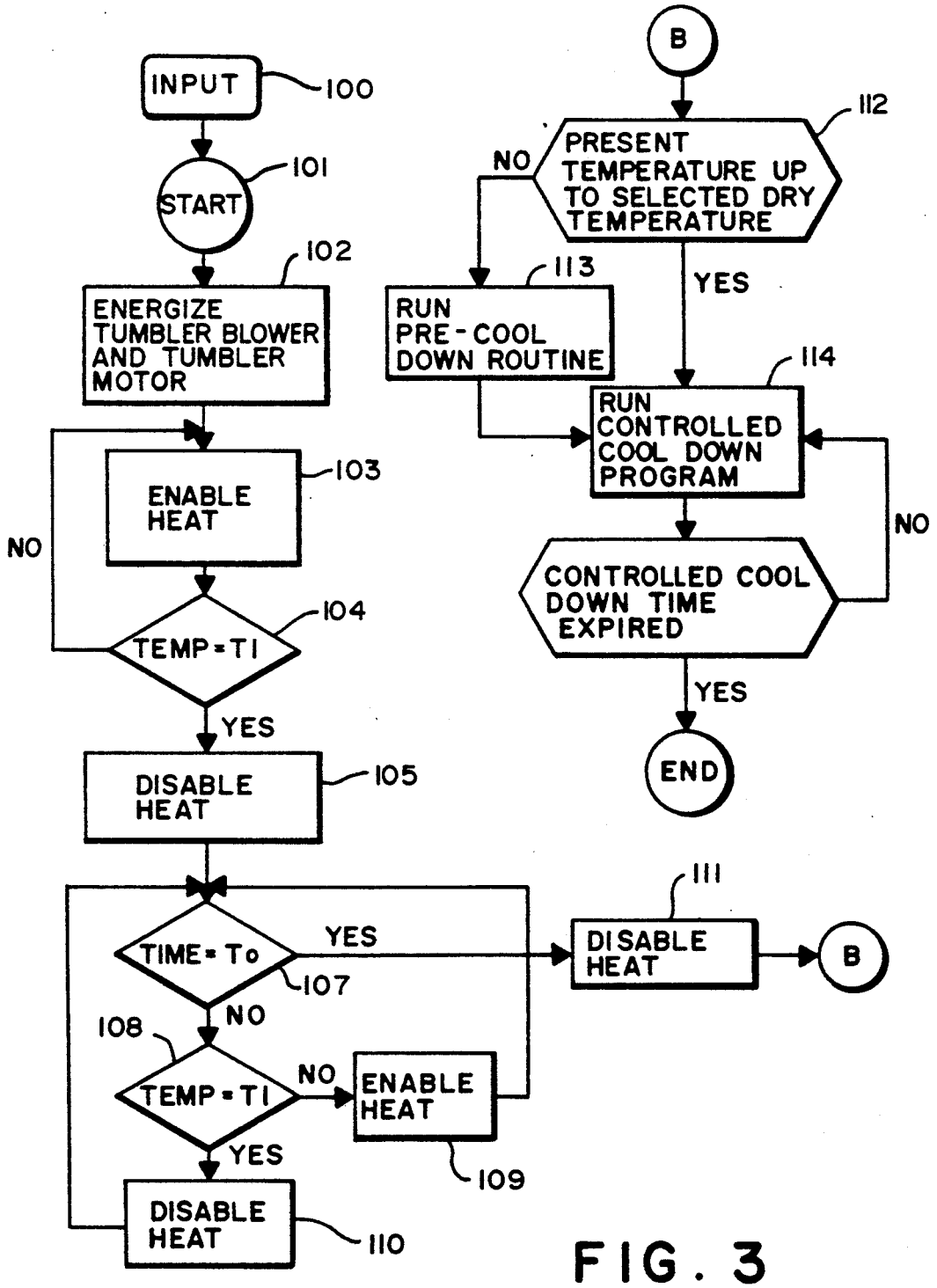
FIG. 3 is a block diagram of the programming steps executed by the microprocessor controller and the operator to complete the drying process.

Referring now to FIG. 3, there is shown the sequence of programming steps executed by the microprocessor controller 13 during the drying cycle, the pre-cool-down cycle and the cool-down cycle. Each of the blocks represents programming steps executed by the microprocessor controller 13. Start block 101 establishes the beginning of the drying sequence. Prior to start block 101, the operator may choose to input information pertinent to the drying process in block 100. Using the keyboard 29 and the display 31 the operator may program into the microprocessor controller 13 the drying time, the drying temperature and the cool-down time. The microprocessor controller 13 will have a default mode which will be activated if no information from the operator is forthcoming, and the microprocessor controller 13 has been instructed to begin the drying process.

Once the microprocessor controller 13 has been activated in block 101, it will energize the tumbler motor 25 in block 102. An enabling signal will also be applied to the burner control circuit 23 as depicted in block 103. Initially, the temperature will increase from ambient to the set point drying temperature preselected by the operator. The microprocessor controller 13 monitors the temperature by measuring the exhaust air temperature with a temperature sensor 15, as is shown in decision block 104. Once the temperature has stabilized at the set point temperature, block 105 will disable the burner 7.

The drying cycle proceeds in a loop, until the drying time $T_0$ has expired (--and after "107"--) as determined by decision block 107 continuously checking set point temperature 108. The burner 7 is enabled or disabled by block 109 and block 110, depending on whether the temperature is above or below the desired temperature $T_1$.

When the elapsed time equals the preprogrammed time set into the microprocessor controller 13 by the operator through keyboard 29, the microprocessor controller 13 disables the burner 7 at block 111 and enters decision block 112. Block 112 is the decision block which insures that the temperature is at the minimum temperature appropriate for starting the cool-down cycle. If the temperature is at or above $T_1$ or within a preprogrammed temperature range thereof, the cool-down cycle is initiated at block 114. If the temperature is below the minimum temperature designated $T_1$, a pre-cool-down program 113 is initiated which raises the drying chamber 1 temperature to the designated $T_1$ temperature. $T^1$ can be preprogrammed into microprocessor controller 13 or selected by the operator.

The pre-cool-down cycle 113 comprises enabling the burner 7, and entering a loop until the minimum temperature range $T_1$ is reached. Once the minimum temperature range $T_1$ is obtained, the cool-down cycle is initiated in block 114. A proper minimum temperature subsequent to the drying cycle and prior to the cool-down cycle insures that the cool-down cycle begins at a relatively consistent temperature irrespective of the ending temperature of the drying cycle. The consistent starting temperature of the cool-down cycle enables the microprocessor controller 13 to provide a linearly decreasing temperature gradient for the duration of the cool-down cycle; the cool-down cycle having a preselected ending cool-down temperature. This starting temperature may be the nominal drying temperature $T_1$.

The cool-down routine in block 114 comprises a series of predetermined burner on and off times generated by the microprocessor controller 13. Experiment has demonstrated that the following values of on-off times create a preferred linearly decreasing temperature profile:

| Cool-Down Time (min.) (Start) | 1 | 2 | 3 | 4 | 5 | 6 | 7 | 8 | 9 | 10 | (End) |
|---|---|---|---|---|---|---|---|---|---|---|---|
| Burner On (sec.) | 4 | 3 | 3 | 3 | 3 | 3 | 3 | 3 | 3 | 3 | |
| Burner Off (sec.) | 1 | 1 | 1 | 2 | 4 | 6 | 6 | 10 | 10 | 10 | |

Figure 4:
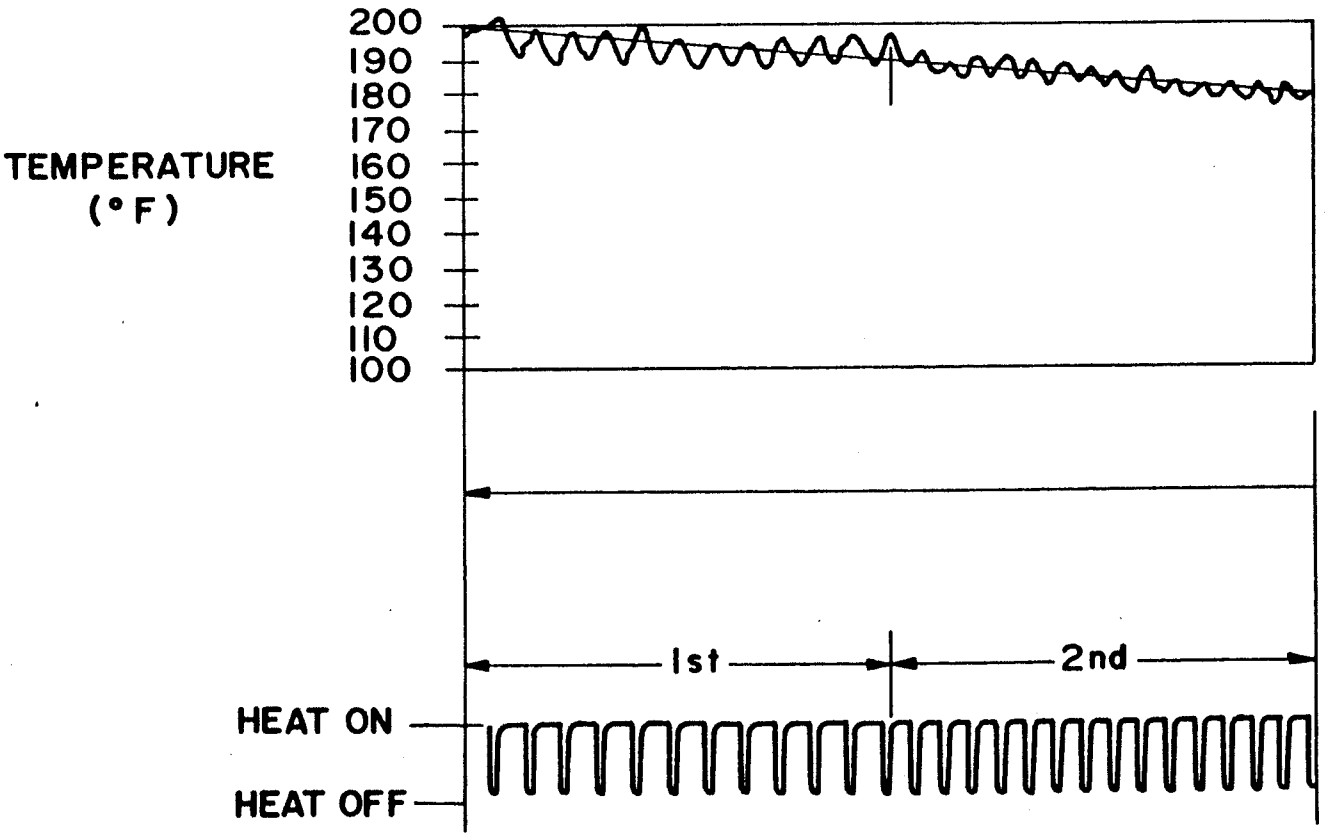
FIG. 4 is a graph representing the drying chamber temperature and the burner on and off times for the first and second minutes of the cool-down cycle.
Figure 5:
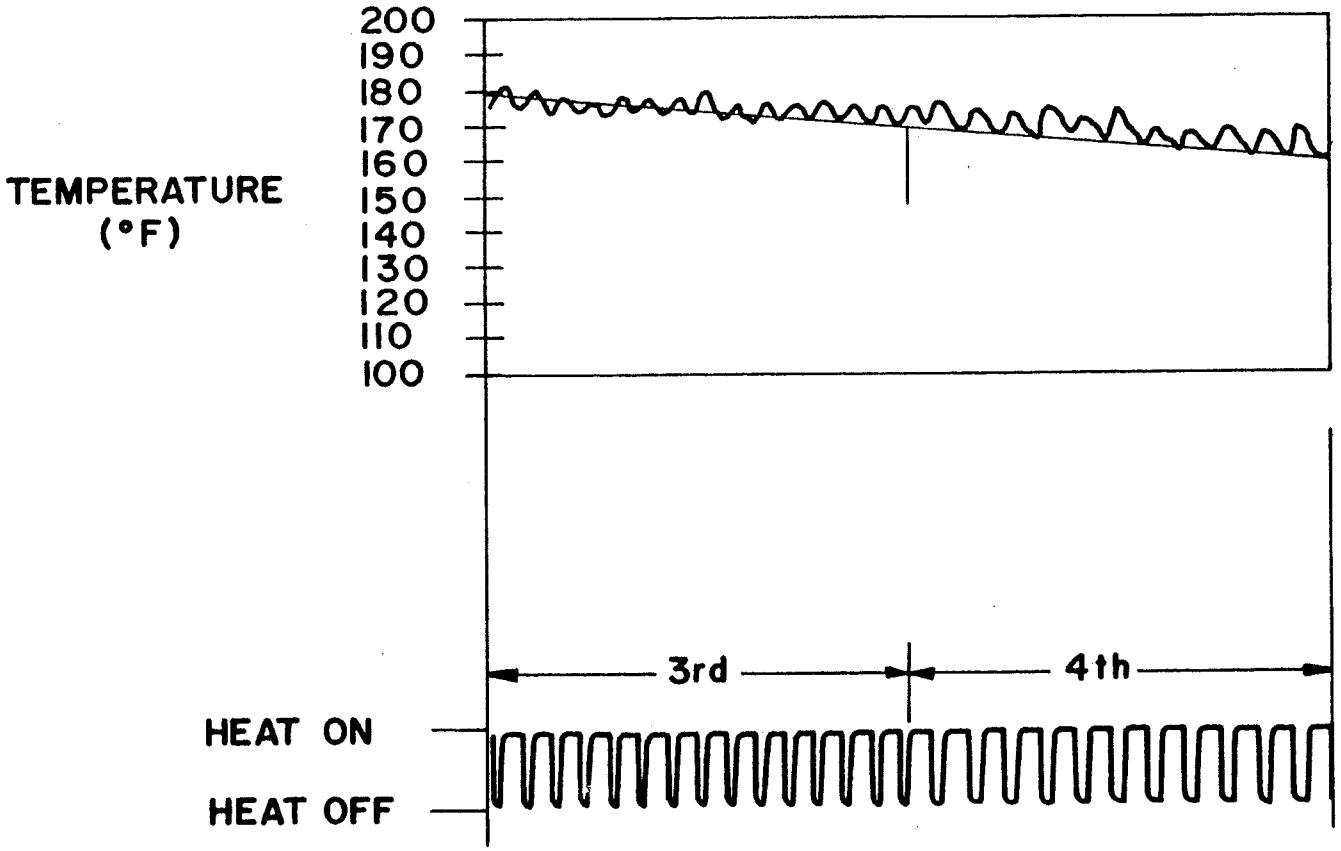
FIG. 5 is a graph representing the drying chamber temperature and the burner on and off times for the third and four minutes of the cool-down cycle.
Figure 6:
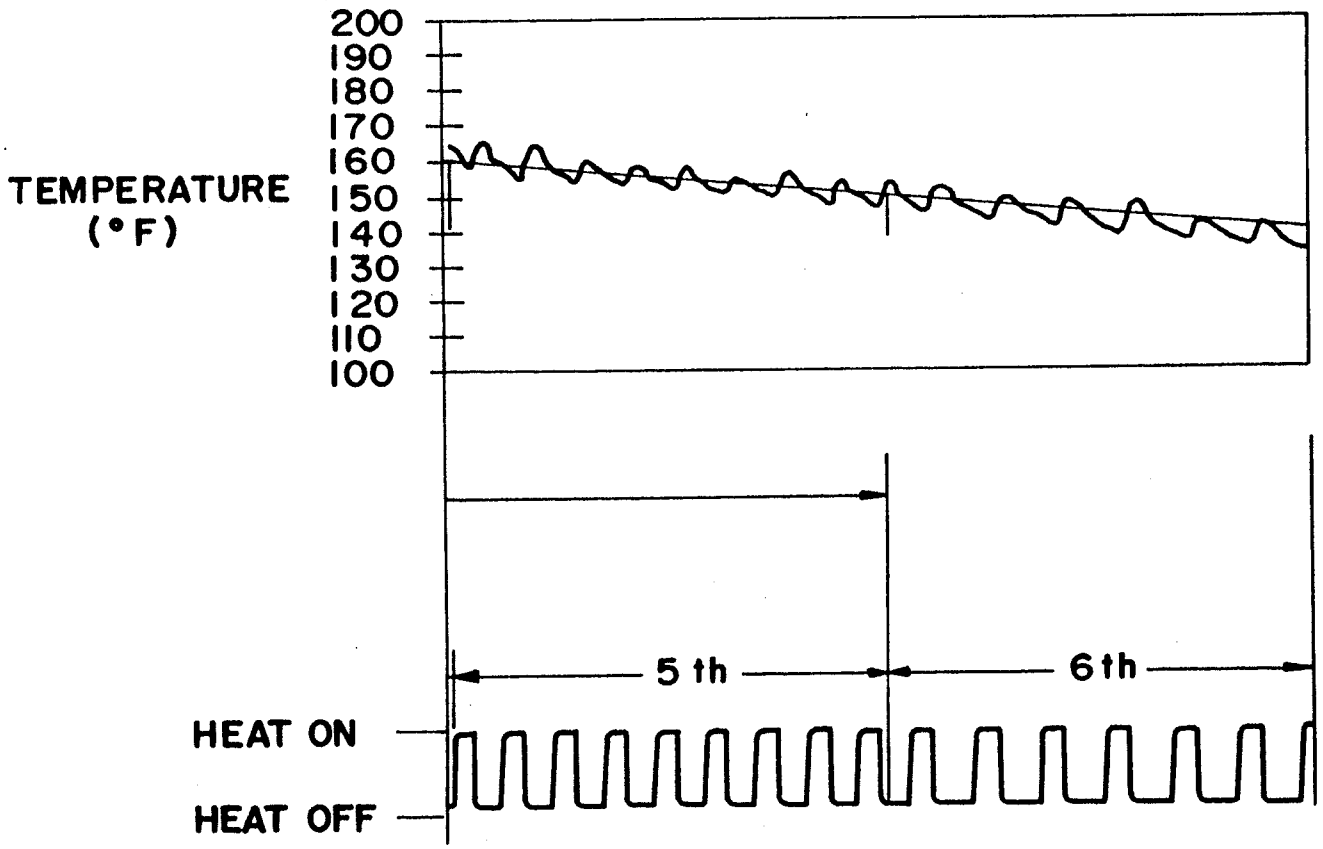
FIG. 6 is a graph representing the drying chamber temperature and the burner on and off times for the fifth and sixth minutes of the cool-down cycle.
Figure 7:
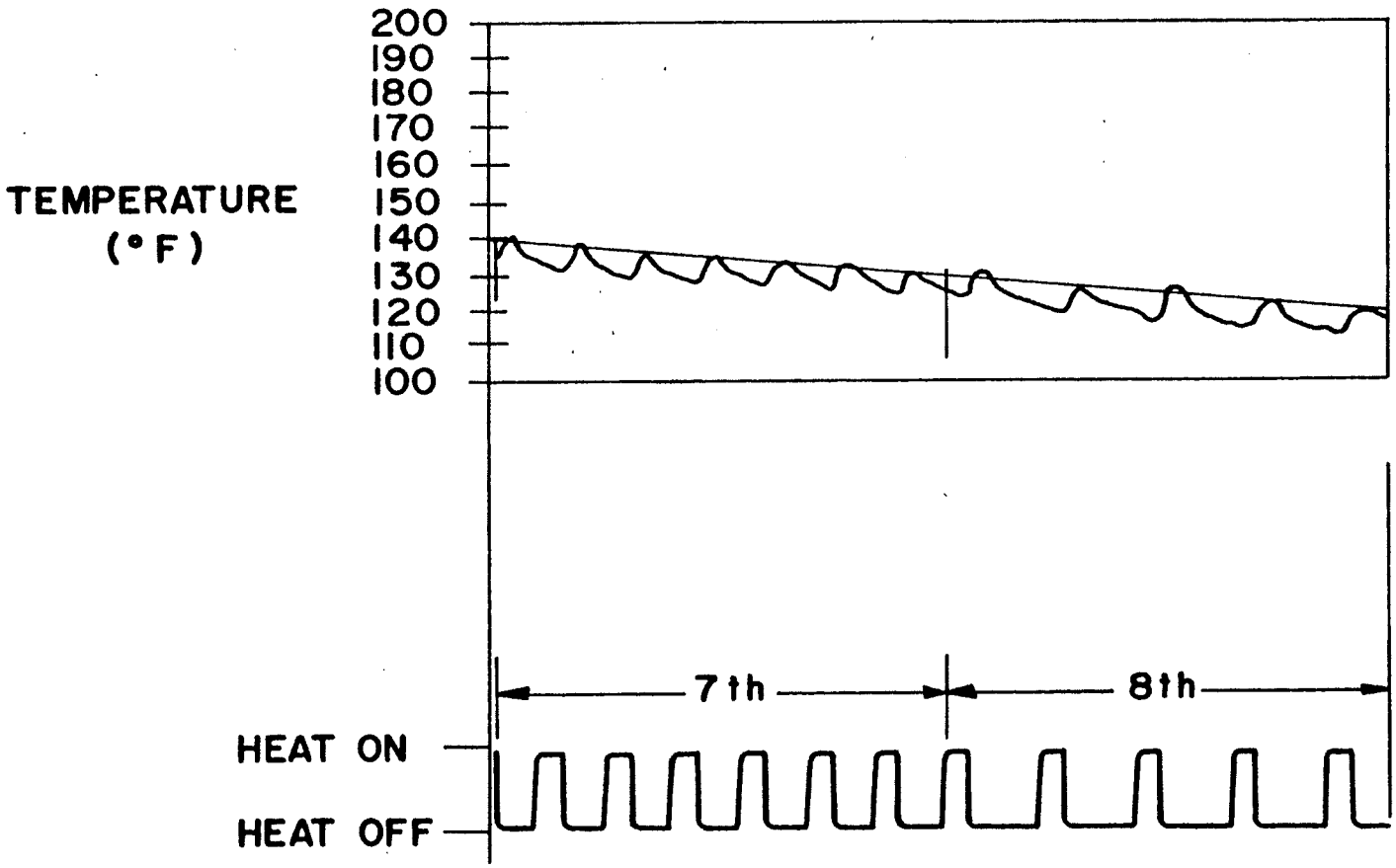
FIG. 7 is a graph representing the drying chamber temperature and the burner on and off times for the seventh and eighth minutes of the cool-down cycle
Figure 8:
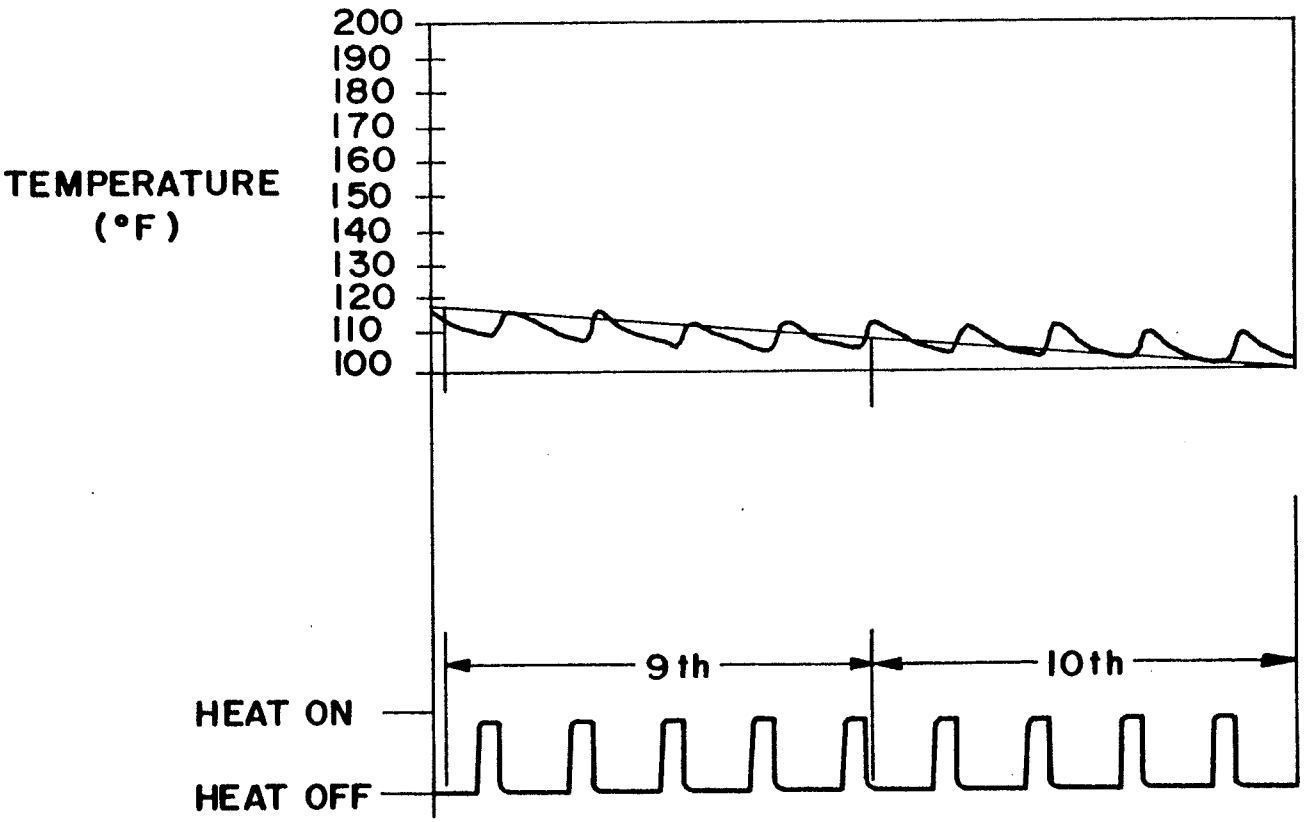
FIG. 8 is a graph representing the drying chamber temperature and the burner on and off times for the ninth and tenth minutes of the cool-down cycle.

As an example, if the operator selects the preferable cool-down cycle duration of ten minutes, the first and second minutes of the of the cool-down cycle, as shown in FIG. 4, will preferably have heat on times of 4 seconds and heat off times of 1 second, and heat on times of 3 seconds and heat off times of 1 second respectively, producing the substantially linear temperature profile shown in the figure. The temperature will fluctuate corresponding to the burner on and off sequences, but will generally follow the linear gradient as shown. The third and fourth minutes, as shown in FIG. 5, will have heat on times of 3 seconds and heat off times of 1 second, and heat on times of 3 seconds and heat off times of 2 seconds respectively, producing the temperature profile shown in the figure. Like FIG. 4, the overall temperature profile is linear with the initial temperature of the third minute 3 being the final temperature of the second minute. The fifth and sixth minutes, as shown in FIG. 6, will have heat on times of 3 seconds and heat off times of 4 seconds and 6 seconds respectively, producing the temperature gradient shown in the figure. Again, the profile is linear with the initial temperature of the fifth minute being the final temperature of the fourth minute. The seventh and eighth minutes, as shown in FIG. 7, will have heat on times of 3 seconds and heat off times of 6 seconds, and heat on times of 3 seconds and heat off times of 10 seconds respectively, producing the temperature profile shown in the figure. The profile is linearly decreasing with the starting temperature being the initial temperature of the sixth minute. The ninth and tenth minutes, as shown in FIG. 8, will have heat on and off times equivalent to the eighth minute, producing a linearly decreasing profile similar to that shown in FIG. 8. The initial temperature will be the final temperature of minute eight and the final temperature of minute ten will be the final temperature of the cool-down cycle, preferably, as shown in the figure, between 85° and 100° F. At the end of the controlled cool-down cycle, the drying operation has been completed. The microprocessor controller 13 will automatically shut down all operations and end the drying operation, and inform the operator that drying is complete by supplying a signal to display 31. The forgoing operations comprise both predefined microprocessor controller 13 inputs that cannot be changed by the changeable commands, and operator inserted through the microprocessor controller 13 keyboard 29. Both sets of commands regulate drying cycle time and temperature and cool-down time and burner sequences. Preferably, the microprocessor controller 13 will have a predefined cool-down cycle time of ten minutes. This insures against the danger of burns or scalding by attempts to remove the materials being dried immediately following the drying cycle. The temperature of such materials can be in the range of 190° to 200° F.

What is claimed is:

1. In a dryer of the type having a burner for supplying a source of hot gas for drying material being tumbled, an apparatus for generating a cool-down cycle following drying of said material to a desired dryness, comprising:

(a) a burner for producing hot gases;

(b) a burner controller means for enabling and disabling said burner for producing said hot gases; and, (c) a microprocessor controller means programmed to provide an enabling signal to said burner controller means to enable and disable said burner for producing said hot gases, in accordance with a sequence which produces a predetermined decreasing temperature profile over time, and generating a signal at the end of said sequence indicating the end of said cool-down cycle.

2. The dryer of claim 1 wherein said microprocessor controller means includes a table of on and off times defining said sequence for said burner, said sequence specifying the time said burner is to be enabled and disabled to provide said predetermined decreasing temperature profile.

3. The dryer of claim 1 wherein said predetermined decreasing temperature profile is a substantially linearly decreasing temperature over time.

4. The apparatus of claim 1 further comprising a temperature sensor connected to said microprocessor controller means said microprocessor controller means entering said cool-down cycle when a sensed temperature is above a predetermined temperature.

5. The apparatus of claim 4 wherein said microprocessor controller means initiates a pre-cool-down cycle for cycling said burner on and off when said temperature is below said predetermined temperature.

6. In a dryer of the type having a burner for supplying a source of hot gas for drying material being tumbled, an apparatus for generating a cool-down cycle for said dryer, comprising:

(a) a sensor for measuring the temperature of hot gases in said dryer;

(b) a burner for producing said hot gases;

(c) a burner controller means for enabling and disabling said burner; and, (d) a microprocessor controller means connected to said sensor and said burner controller means, programmed to provide a drying cycle, a pre-cool-down cycle and a cool-down cycle wherein:

(1) said drying cycle comprising a signal sequence for enabling and disabling said burner to maintain a constant temperature for a predetermined time;

(2) said pre-cool-down cycle comprising a signal sequence establishing an initial temperature for said cool-down cycle; and, '(3) said cool-down cycle comprising a signal sequence operating said burner controller means at predetermined on and off times to produce a preselected temperature profile which decreases over time.

7. The dryer of claim 6 wherein said microprocessor controller means is programmed to provide said cool-down cycle signal sequence for the duration of ten minutes.

8. The dryer of claim 6 wherein said microprocessor controller means is programmed to provide preselected drying cycles extending from zero to ninety-nine minutes in duration.

9. The dryer of claim 6 wherein initial pre-cool-down temperature is preselected by an operator of said dryer.

10. The dryer of claim 6 wherein said cool-down cycle produces a temperature profile which decreases linearly over time.

11. A process for generating a cool-down cycle for a dryer of the type having a tumbler which receives hot gases for drying tumbled material comprising:

(a) producing hot gases from a burner;

(b) controlling said burner by enabling and disabling said burner for producing hot gases at a constant temperature for a predetermined time whereby a drying cycle is completed;

(c) pre-cooling said dried material to a predetermined initial temperature following said drying cycle; and (d) cooling said material from said initial temperature by enabling said disabling said burner to establish a predefined temperature profile for a predefined time interval.

12. The process of claim 11 wherein said predefined temperature profile is a linear decreasing temperature versus time function.

13. The process of claim 11 further comprising monitoring said constant temperature during said drying cycle, and said pre-cool-down cycle is entered at the expiration of said drying cycle to maintain said temperature at a predetermined minimum.

14. The process of claim 13 wherein said pre-cool-down cycle is entered for cycling said burner until a predetermined temperature is measured.

15. The process of claim 13 further comprising inhibiting said pre-cool-down cycle when said constant temperature is indicated by a temperature monitor to be at a predetermined minimum.

16. A process for controlling a dryer of the type having a tumbler which receives hot gases for drying tumbled material during a cool-down cycle following drying said material to a desired dryness comprising:

(a) producing hot gases from a burner;

(b) measuring the temperature of said hot gases in said burner;

(c) controlling said burner by enabling and disabling said burner for producing hot gases to produce a substantially constant temperature;

(d) pre-cooling said drying material to a predetermined initial temperature, and (e) cooling said material from said initial temperature at a substantially linear rate for a period of time defining said cool-down cycle.

* * * * *